United States Patent [19]

Borer

[11] Patent Number: 4,575,655

[45] Date of Patent: Mar. 11, 1986

[54] CATHODE RAY TUBE ELECTRON GUN SNUBBER

[76] Inventor: Michael E. Borer, 4750 70th St., #21, La Mesa, Calif. 92041

[21] Appl. No.: 566,126

[22] Filed: Dec. 27, 1983

[51] Int. Cl.[4] ..... H01J 29/02; H01J 29/48

[52] U.S. Cl. ..... 313/417; 313/456

[58] Field of Search ..... 313/417, 456, 457, 482, 313/238, 292, 286, 285

[56] References Cited

U.S. PATENT DOCUMENTS 2,847,599 8/1958 Kaseman ..... 313/456

2,947,897 8/1960 Rodriguez et al. ..... 313/457 X

*Primary Examiner*—Palmer C. DeMeo

*Assistant Examiner*—Sandra L. O'Shea

[57] ABSTRACT

The gun of a cathode ray tube (CRT) is held precisely centered in the neck of the CRT by a pair of cylindrical spacers and a spring, all equally spaced around the electron gun.

5 Claims, 4 Drawing Figures

FIG. 1.
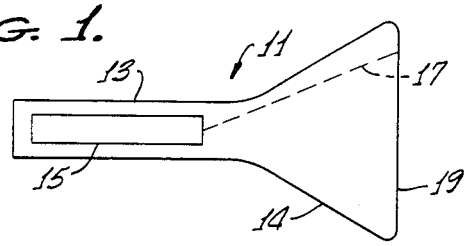
FIG. 3.
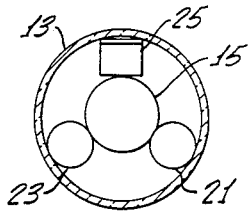
FIG. 2.
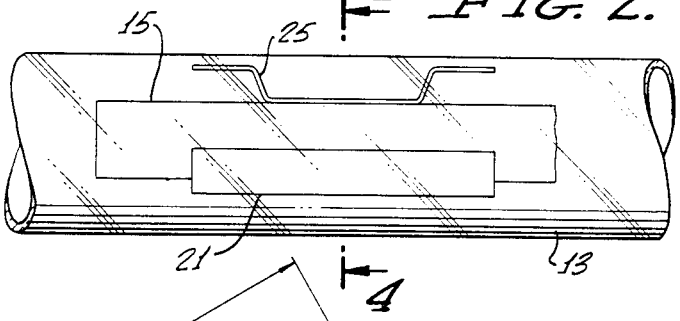
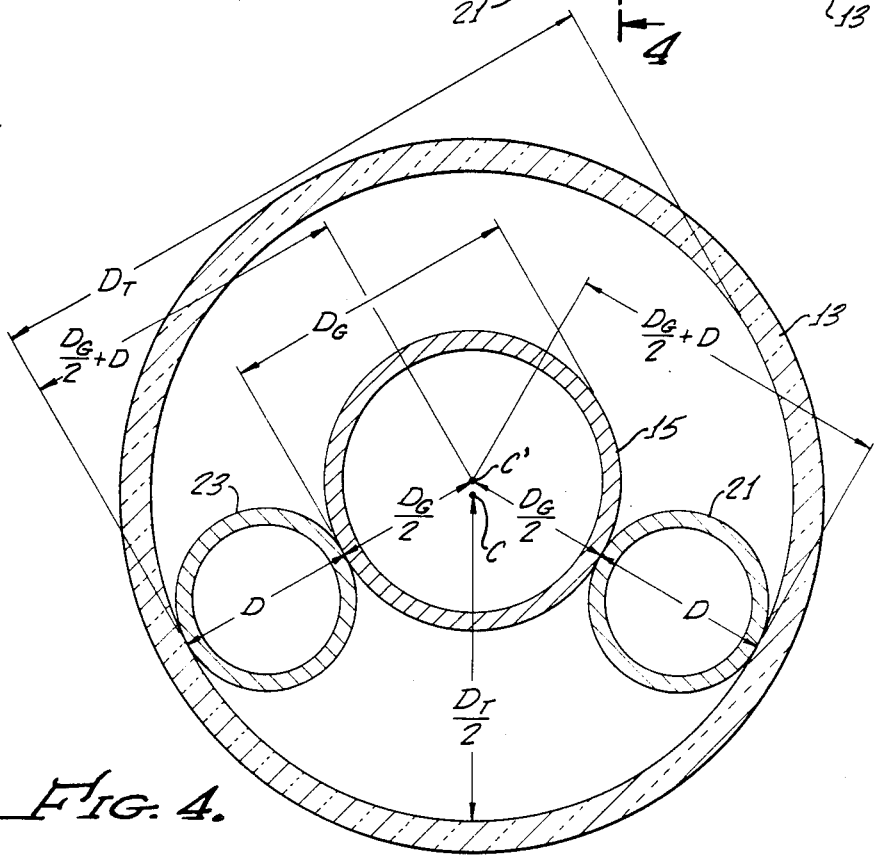
FIG. 4.

CATHODE RAY TUBE ELECTRON GUN SNUBBER

BACKGROUND OF THE INVENTION

1. Field of the Invention

The subject invention relates generally to cathode ray tubes and, in particular, to arrangements for precisely centering the electron gun of the cathode ray tube within the neck of the tube.

2. Description of the Prior Art

Two current expedients commonly used to center a cylindrical electron gun within the neck of a cathode ray tube (CRT) are adjustment and fixturing. With the adjustment method, three equally spaced springs inside the CRT neck serve to center the electron gun therein in a shock mounted fashion. Centering is accomplished by rotating the CRT about its axis on a lathe and adjusting the position of the electron gun therein so as to reduce the observed excursion of the electron gun to a minimum. Concentricity achieved by this method between the CRT neck and the electron gun mounted therein has been found to be off by as much as 0.016 inches TIR (Total Indicator Reading, measuring maximum excursion of gun during 360-degree rotation of CRT). Fixturing involves pre-centering the electron gun in a fixture which emulates the CRT neck, and is not suitable for miniature CRT's because of the room required for the necessary components.

Accordingly, it is a principal object of the present invention to provide improved alignment of an electron gun in the neck of a CRT over methods which are now available for miniature CRT's. A related object of the invention is to simplify the manner in which an electron gun is centered in the neck of a CRT.

SUMMARY OF THE INVENTION

In accordance with the present invention, an electron gun is held precisely centered along its length within the neck of a CRT by means of a snubber which includes a pair of spacers, each extending within the neck of the CRT parallel to the gun and located between the gun and the CRT's neck. Each of the spacers presents a centering support surface having a circular cross-section at two or more points along the length of the gun, with all support surfaces having the same diameter. The electron gun is pressed against the pair of spacers, preferably by a spring disposed within the CRT neck between the wall of the neck and the electron gun. By selecting the dimensions of the spacers according to the relationship $$D_T/2=D+D_G/2,$$

where $D_T$=inside diameter of CRT neck, $D_G$=outside diameter of electron gun, and D=outside diameter of spacer support surfaces, the centering of the electron gun within the CRT neck is assured along the full length of the gun. Thus, by means of the pair of spacers and the spring, not only is the electron gun located axially within the CRT neck, it is held precisely centered and in coaxial alignment therewith.

BRIEF DESCRIPTION OF THE DRAWINGS

FIG. 1 is a diagrammatic illustration of a CRT wherein the present invention finds its principal use.

FIG. 2 is a side view of the neck of the CRT and of the electron gun housed therein.

FIG. 3 is an end view of the arrangement illustrated in FIG. 2.

FIG. 4 is a magnified cross-section along lines 4—4 of FIG. 2 illustrating the relevant dimensions of the CRT neck, the electron gun and the spacers, and with the biasing spring omitted for sake of clarity.

A simplified view of a typical CRT 11 wherein the present invention will find its primary utility is shown in FIG. 1. It includes a glass envelope having a cylindrical neck 13 connected by an intermediate funnel shaped portion 14 to a flat face plate 19. Housed within the CRT neck 13 is a cylindrical electron gun 15 whose function is to generate a beam of electrons 17 which is projected toward and scanned cross the face plate 19 by means which are not shown. For proper functioning of a CRT, it is essential that the electron gun 15 be centered within the CRT neck 13. The manner in which this is accomplished according to the present invention is illustrated in FIGS. 2 and 3. Extending at least partly along the electron gun 15 are a pair of spacers 21 and 23 which in the preferred embodiment are cylindrical rods, and in a particularly preferred embodiment are stainless steel tubes. The spacers 21 and 23 are disposed in adjacent quadrants of the circular cross-section of the CRT neck 13. Located at the center of the remaining quadrants of that cross-section is the spring 25.

Preferably the spacers 21 and 23 and the spring 25 are all made of steel and are held in place by welding them to the electron gun 15 so as to form a single assembly therewith. That assembly may then be easily slid into the CRT neck 13 wherein it will become automatically and accurately centered. The arrangement takes advantage of the precision to which the outside diameter of the electron gun 15 and the inside diameter of the CRT neck 13 are held in their normal manufacture. Inspection of FIG. 4 will show that, with the electron gun 15 directly adjacent to the spacers 21 and 23, the axis C′ of the electron gun 15 will coincide with the axis C of the CRT neck 13, provided that the spacers 21 and 23 are dimensioned according to the relationship $$D_T/2=D+D_G/2,$$

where $D_T$=inside diameter of CRT neck, $D_G$=outside diameter of electron gun, and D=outside diameter of spacer support surfaces.

While the use of cylindrical tubes is preferred for the spacers 21 and 23, it will be appreciated that the essence of the invention is the provision of cylindrical centering support surfaces at two or more points along the length of the electron gun 15, which of course is provided by the cylindrical tubes. They could, however, also be provided by solid rods having the desired diameter, or by a very thin rod having intermittent raised circular sections having the prescribed diameter and serving as the support surfaces.

Use of the invention has been found to improve the concentricity between the electron gun 15 and the neck 13 of a CRT significantly. Thus, with a tolerance of ±0.001 on the electron gun 15, ±0.00005 on the diameters of the spacers 21 and 23, and ±0.0001 on the internal diameter of the CRT neck 13, the alignment of the CRT neck 13 within the electron gun 15 was found to be within 0.0025 inches TIR. This is consistent with the expected precision of the alignment obtainable with the present invention, which should be the total variance in the above three tolerances. By comparison, existing centering arrangements have been found to result in the concentricity between the CRT neck 13 and the electron gun 15 to be off by as much as 0.016 inches TIR.

What is claimed is:

1. In a cathode ray tube (CRT) having an elongate neck housing an electron gun extending along said neck, said CRT neck and electron gun having circular cross-sections, an improved snubber for maintaining said gun precisely centered along its length within said CRT neck, comprising a pair of cylindrical spacers attached to said electron gun in adjacent quadrants of the circular cross-section of said CRT neck, each spacer extending within said CRT neck parallel to said gun between said gun and said neck and in contact with both of them, each said spacer presenting a centering support surface having a circular cross-section at two or more points along the length of said electron gun, all of said support surfaces having the same diameter, and resilient biasing means attached to said electron gun in the remaining quadrants of said cross-section and compressed between said electron gun and said CRT neck.

2. The snubber of claim 1 characterized further in that said resilient biasing means is a steel spring welded to said electron gun, and in that said pair of spacers are steel tubes also welded to said electron gun.

3. The snubber of claim 2 characterized further in that said spring and said pair of spacers are located substantially 120 degrees apart.

4. In a cathode ray tube (CRT) having an elongate neck housing an electron gun extending along said neck, said CRT neck and electron gun having circular cross-sections, an improved snubber for maintaining said electron gun precisely centered along its length within said CRT neck comprising:

(a) a pair of cylindrical spacers attached to and carried by said gun approximately 120° apart and extending within said CRT neck parallel to said electron gun between said electron gun and said neck, and in contact with both, said spacers both having a diameter defined by the relationship $$D_T/2=D+D_G/2,$$

where $D_T$=inside diameter of CRT neck, $D_G$=outside diameter of electron gun, and D=outside diameter of spacer; and (b) a spring attached to and carried by said gun approximately 120° from both of said spacers and compressed between said neck and said electron gun.

5. The snubber of claim 4 characterized further in that said electron gun, spring, and spacers are made of steel and form a single assembly wherein said spring and said spacers are welded to said electron gun.

* * * * *

UNITED STATES PATENT AND TRADEMARK OFFICE

CERTIFICATE OF CORRECTION

PATENT NO. : 4,575,655

DATED : March 11, 1986

INVENTOR(S) : Michael E. Borer

It is certified that error appears in the above-identified patent and that said Letters Patent is hereby corrected as shown below:

On the first page, add the Assignee and Attorneys' names, as follows:

--Assignee: Hughes Aircraft Company, Culver City, California--

--Attorney, Agent, or Firm: Joseph E. Szabo; Anthony W. Karambelas--.

At Col. 2, line 67, "±0.00005" should read --±0.0005--.

At Col. 2, line 68, "±0.0001" should read --±0.001--.

Signed and Sealed this

Eighteenth Day of November, 1986

*Attest:*

DONALD J. QUIGG

*Attesting Officer* *Commissioner of Patents and Trademarks*